United States Patent [19]

Moore

[11] 4,157,271

[45] Jun. 5, 1979

[54] DRYWALL JOINT FILLER

[76] Inventor: Dan B. Moore, P.O. Box 1060, Huntington, W. Va. 25701

[21] Appl. No.: 904,221

[22] Filed: May 9, 1978

Related U.S. Application Data

[63] Continuation of Ser. No. 805,451, Jun. 10, 1977, abandoned, which is a continuation of Ser. No. 568,945, Apr. 17, 1975, abandoned.

[51] Int. Cl.[2] ..... E04B 2/72; E04B 2/00

[52] U.S. Cl. ..... 156/71; 52/255; 52/288; 52/417; 156/280; 156/304

[58] Field of Search ..... 52/255, 288, 417, 743, 52/744, 747; 156/71, 280, 304

[56] References Cited

U.S. PATENT DOCUMENTS

| | | | |
|---|---|---|---|
| 129,450 | 7/1872 | Appleton | 52/716 |
| 1,312,056 | 8/1919 | Shaw | 52/468 |
| 1,691,179 | 11/1928 | Betz | 52/471 X |
| 1,936,317 | 11/1933 | Walker et al. | 52/417 |
| 2,440,936 | 5/1948 | Elmendorf et al. | 52/483 |
| 3,339,329 | 9/1967 | Berg | 52/461 X |
| 3,413,775 | 12/1968 | Katz | 52/254 X |
| 3,444,657 | 5/1969 | Swanson | 52/288 |
| 3,604,169 | 9/1971 | Smith | 52/288 |
| 3,741,843 | 6/1973 | Louis | 220/334 X |
| 3,760,544 | 9/1973 | Hawes et al. | 52/468 |
| 3,771,277 | 11/1973 | Rausch et al. | 52/468 |

FOREIGN PATENT DOCUMENTS

| | | | |
|---|---|---|---|
| 619991 | 5/1961 | Canada | 156/304 |
| 675986 | 12/1963 | Canada | 52/287 |
| 769347 | 10/1967 | Canada | 52/288 |
| 959983 | 6/1964 | United Kingdom | 428/99 |

*Primary Examiner*—Alfred C. Perham
*Attorney, Agent, or Firm*—Cushman, Darby & Cushman

[57] ABSTRACT

A drywall joint filler for joining together two conventional drywall building panels formed as an extending flexible strip of plastic or the like having a central spline which extends into the space between the panels to properly locate the joint and which tapers to a feather edge as it extends away from the spline. The spline is preferably provided with whiskers or spurs to provide additional holding forces. The joint is preferably adhered to the abutting panels by double-coated adhesive paper strips.

2 Claims, 5 Drawing Figures

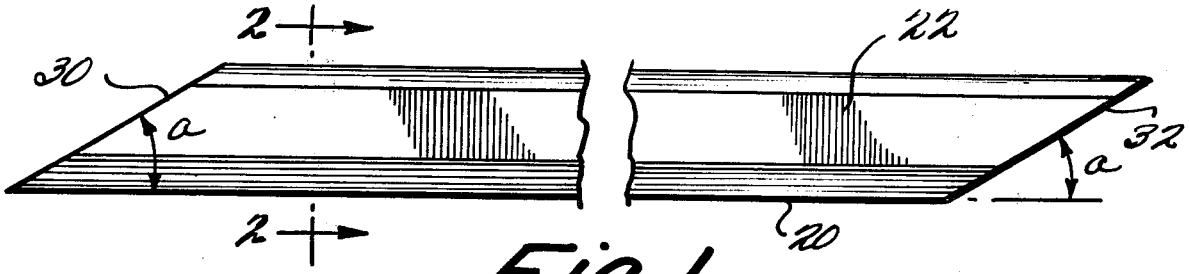
Fig. 1
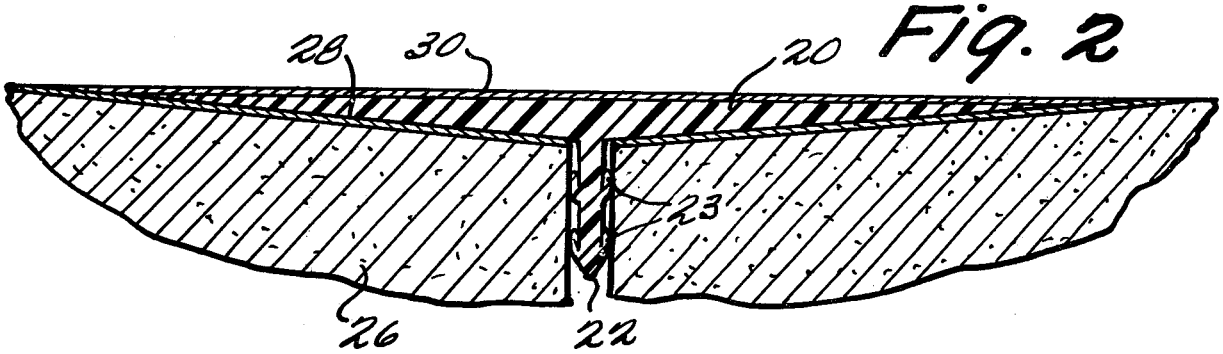
Fig. 2
Fig. 5
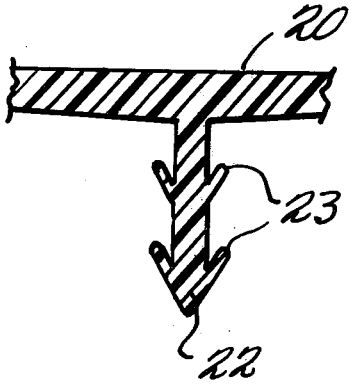
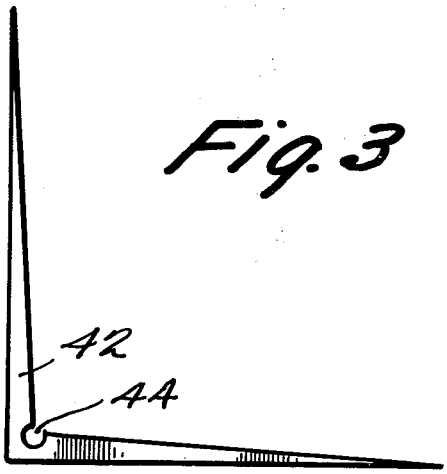
Fig. 3
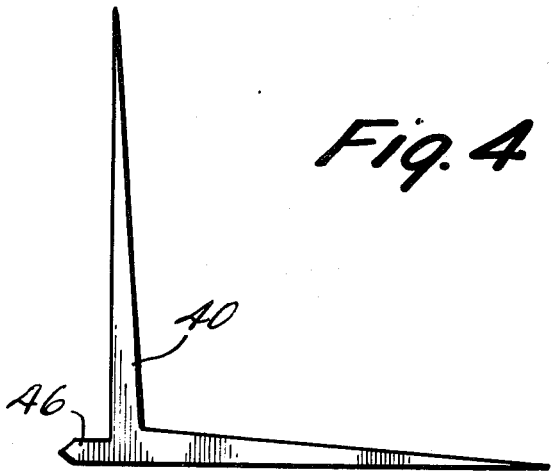
Fig. 4

DRYWALL JOINT FILLER

This is a continuation of application Ser. No. 805,451 filed June 10, 1977 now abandoned which is a Rule 60 continuation of Ser. No. 568,945 filed Apr. 17, 1975 now abandoned.

BRIEF DESCRIPTION OF THE PRIOR ART AND SUMMARY OF THE INVENTION

The invention relates to an improved method of filling in and finishing the tapered joint of two abutting drywall panels.

Drywall building panels are widely used conventional materials in building construction, particularly for forming relatively inexpensive and durable walls. The panels are normally manufactured in dimensions of 4' × 8', 4' × 9', 4' × 10', 4' × 12' and are nailed or otherwise adhered to wooden studs or concrete blocks which form a vertical support for the wall. While the drywall panels themselves can be quickly nailed or otherwise placed to form the wall, the joint between the individual panels normally must be filled in with paper tape and drywall cement before the wall is painted or covered. This operation conventionally is both time consuming and difficult.

Conventional wall boards are slightly tapered at the edges thereof so that when a joint is formed by abutting edges of adjoining wall boards, a slight depression around the joint results. This depression is filled with drywall joint cement and drywall tape sometimes called Perfatape ®, an absorbent paper tape, and sanded repeatedly with drying times of usually a day or more required between each application of drywall cement. The drying times ensure that the job cannot be completed in less than 3–4 days. Further, sanding the plaster is both a tedious and unpleasant task and requires skill and patience as three coats are usually required and each coat must dry 24 hours. It is a very dusty job also. On a remodeling job the dust usually gets all over the house—into the drapery, carpet, furniture. The dust is circulated throughout the house via the heating system where forced air heating and cooling is present.

In order to eliminate this time consuming and difficult job, it has been proposed in the past to use a joint strip to cover the joint and depression formed between abutting drywall panels. For example, the patent to Swanson, U.S. Pat. No. 3,444,657 describes a joint structure in which a molded plastic material such as a strip of semi-rigid vinyl plastic having a tapered cross-section, fills the depression. However, according to the system described in Swanson the drywall panels must be of a special construction and particularly must have a shoulder defining the edge of the depression away from the edge which is used to locate the strip. The requirement for special wall panels limits the use of this type of strip to particular types of panels not generally available and, moreover, effectively precludes use of the system by individual construction companies and others unless special panels are manufactured. Other patents in the prior art, for example, the patents to Walker et al., U.S. Pat. No. 1,936,317, Shaw, U.S. Pat. No. 1,312,056, Betz, U.S. Pat. No. 1,691,179 and Van Etten, U.S. Pat. No. 3,289,370, show structures for joining panels which have a T-shaped cross-section with portions which extend into the space between the two abutting panels.

The present invention relates to a joint and a method of joining drywall panels whereby conventional panels now in use can be employed to produce a satisfactory joint in two or three minutes in contrast with the large effort and several days time required to finish drywall joints according to conventional techniques now in use. This is accomplished by the use of a joint which is formed as an extending strip with a center spline extending outwardly from the strip near the center thereof and which tapers along the dimension of the width in both directions away from the center spline to a feather edge so that no special abutting shoulders are required. The strip is formed of a flexible material such as molded vinyl plastic or other material so that the material can be bent to use the spline to easily locate the space between abutting panels. A double edged adhesive paper strip is preferably used to attach the strip to adjoining drywall panels with the spline extending into the space between the panels. The spline is preferably provided with whiskers or spurs to help hold the strip in place vertically straight and equidistant to the tapered edge of the drywall panel. The ends of the strip, at opposite ends of its length, can be tapered in the same direction, for example, forming an angle with the horizontal of about 10° so as to readily mate with other strips, for example, where the 4' × 8' building panels are being installed with the large dimension horizontal and so that any small contractions or expansions will not be noticeable.

Many other objects and purposes of the invention will become clear from the following detailed description of the drawings.

BRIEF DESCRIPTION OF THE DRAWINGS

FIG. 1 shows a side view of the drywall strip according to this invention.

FIG. 2 shows a sectional view of the strip of FIG. 1 along the lines 2—2.

FIG. 3 shows another type of drywall joint which can be used for joining outside corners.

FIG. 4 shows another type of drywall joint which can be used for joining inside corners.

FIG. 5 shows an enlarged view of the spline and spurs of the joint of FIG. 2.

DETAILED DESCRIPTION OF THE DRAWINGS

Reference is now made to FIGS. 1–2 which illustrate one embodiment according to this invention. As discussed briefly above, strip 20 is preferably formed of vinyl molded plastic, or other material and is provided with a central spline 22 which extends into the space between abutting wall boards 24 and 26 as can be best seen in FIG. 2. Spurs or whiskers 23 on spline 22 help hold strip 20 in place. Furthermore, the thickness of strip 20 decreases along the dimension of its width away from the central spline 20 so as to fill up the depression which is normally formed by abutting wall boards as discussed briefly above. It has been found that vinyl plastic and the like can be satisfactorily sanded to a feather thickness which leaves no ascertainable transition line between the strip and the wall board. A heavy-bodied drywall sealer or thick latex wall paint should fill any hairline cracks on the edges of the filler strip. This is reinforced by the double-coated polyester tape. Tape may be acrylic, polyester, mylar or other material.

Strip 20 is preferably attached to the wall boards 24 and 26 by means of a conventional double-coated polyester tape or similar material. The drywall installer using a spacer strip will nail up the panels 1/16" apart. Preferably the double-coated tape is placed on opposite sides of the joint with the protective paper removed and the strip placed by flexing the tapered ends thereof away from the wall board and using the spline 22 to easily and quickly locate the space between wall boards 24 and 26. Spline 22 therefor serves as a simple and effective way to properly place the strip. Wall paper 30, paint or any other suitable coating for wall boards 24 and 26 can then be simply placed over the attached strip 20.

Referring to FIG. 1, strip 20 can be tapered at its ends 30 and 32 in the same direction as shown to easily mate with the end of another tape and to make location of such tapes an easy matter and also so that contraction and expansion of abutting strips will not be noticeable.

A width of spline 22 is preferably of the order of 1/16 of an inch and a maximum thickness of strip 20 of that same dimension, without the splines 22, has been found satisfactory. Spline 22 preferably extends about $\frac{1}{4}''$ above the surface of strip 20. Each of the seven or eight manufacturers of gypsum board (drywall) has tapers of different dimensions, the largest taper being approximately $4\frac{3}{4}'$.

FIGS. 3 and 4 illustrate further strips 40 and 42 which can be used for joining inside and outside corners of drywall joints respectively. Strip 42 has a central portion 44 removed which permits the strip to be easily bent to an L-shaped configuration as illustrated in FIG. 3 which fits over the top of metal-outside drywall cornerbead. Strip 40 is provided with a spline 46 which extends into the space between abutting wall boards and, like spline 22, serves to properly locate strip 40. Like strip 20, strips 40 and 42 can be held in place by double-edged adhesive paper and then be painted or papered as desired.

Many changes and modifications in the above described embodiment of the invention can, of course, be carried out without departing from the scope thereof. Accordingly, that scope is intended to be limited only by the scope of the appended claims.

What is claimed is:

1. A method of joining a pair of abutting drywall panels comprising:

placing an extending strip of flexible material having a spline extending outward from the strip near the center of the width and along the length and a thickness which tapers away from said spline with said spline in the space between the abutting panels, adhering the surfaces of said strips extending away from said spline to the surfaces of said abutting panels extending away from said space, and covering said strips with a coating to form a smooth surface.

2. A method as in claim 1 wherein said step of adhering includes the step of placing a double sided adhesive paper on said surfaces of said strip extending away from said spline.

* * * * *